United States Patent [19]

Kincaid

[11] Patent Number: 4,623,037

[45] Date of Patent: Nov. 18, 1986

[54] DETACHABLE-GAFF POLE CLIMBER

[76] Inventor: William J. Kincaid, 929 Brass Way, Encinitas, Calif. 92024

[21] Appl. No.: 797,931

[22] Filed: Nov. 14, 1985

[51] Int. Cl.[4] ..... A63B 27/00

[52] U.S. Cl. ..... 182/221; 182/134

[58] Field of Search ..... 182/221, 134, 135

[56] References Cited

U.S. PATENT DOCUMENTS

| | | | |
|---|---|---|---|
| 628,070 | 7/1899 | Butler | 182/221 |
| 2,484,181 | 10/1949 | Munger | 182/221 |
| 2,519,589 | 8/1950 | Miller | 182/221 |
| 3,867,998 | 2/1975 | Joseph | 182/221 |
| 4,153,139 | 5/1979 | Houch | 182/221 |

*Primary Examiner*—Reinaldo P. Machado

*Attorney, Agent, or Firm*—Charmasson & Holz

[57] ABSTRACT

A climber of the type that attaches to a boot for climbing trees and poles. The climber comprises a set of leg braces, articulated stirrup mounting and a quick gaff release assembly which facilitates detaching and replacing the gaff, and provides safety and comfort to the user.

7 Claims, 5 Drawing Figures

1
2
3
4
5
7
8
9
10
11
12
14
15
16
17
18
19
20
21
22
23
24
25
26
27
28
29

DETACHABLE-GAFF POLE CLIMBER

BACKGROUND OF THE INVENTION

The present invention relates to a pole and tree climber with a gaff release assembly and a detachable gaff.

The development of this type of climber is well exampled in U.S. Pat. Nos. 3,867,998 by Joseph, and 4,153,139 by Houch. In those patents, representative of the prior art, the gaff employed is either welded to the main body of the climber, or is tediously replaceable by unscrewing it from the main body.

Typically, a workman climbing wooden poles utilizes a climber secured to the inner side of his legs. A spur or a gaff extends generally outward and is pointed for a forced insertion into the wooden pole, to provide climbing support.

The gaff is subjected to various forces which act to wear it down. In instances where the gaff is permanently secured to the climber, a replacement of the gaff necessitates the replacement of the entire climber device. On the other hand, in known devices where the gaff is detachably mounted, the device is succeptible to either rotating or coming off completely if a component breaks, thus endangering the workman wearing the device.

Furthermore, in all those devices with a detachable gaff, the replacement of the gaff is a cumbersome process, whereby the workman has to take off the device, unscrew the gaff from the vertical metallic sleeve, replace tha gaff and then put the screws back on. Another disadvantage of those older devices is that the spur or gaff presents a substantial physical danger to the user when walking, running or commuting between the poles to be climbed.

Another disadvantage common to the prior art devices is that they comprise an upright on either or both sides of the leg which connects rigidly with a stirrup, preventing dorsal flexion and thus making it very difficult to walk.

SUMMARY OF THE INVENTION

It is the primary object of the present invention to provide an improved climber having a replaceable gaff and a quick gaff release assembly, wherein no permanently attaching device is used.

It is another object of the present invention to provide an improved climber having a replaceable gaff and a generally secure mounting arrangement, wherein the loss of one attaching device does not cause the loss of the gaff.

It is still another object of the present invention to provide an improved climber device having a structure and gaff mounting assembly that provide safety for the workman while using the climber and while walking or commuting between poles.

A further object of the invention is to provide a climber which is articulated about the ankle to allow dorsal flexion when walking.

BRIEF DESCRIPTION OF THE DRAWINGS

FIG. 6 is a front view of the climber.

DESCRIPTION OF THE PREFERRED EMBODIMENT OF THE INVENTION

Figures 1, 2, 3, 4, 5:
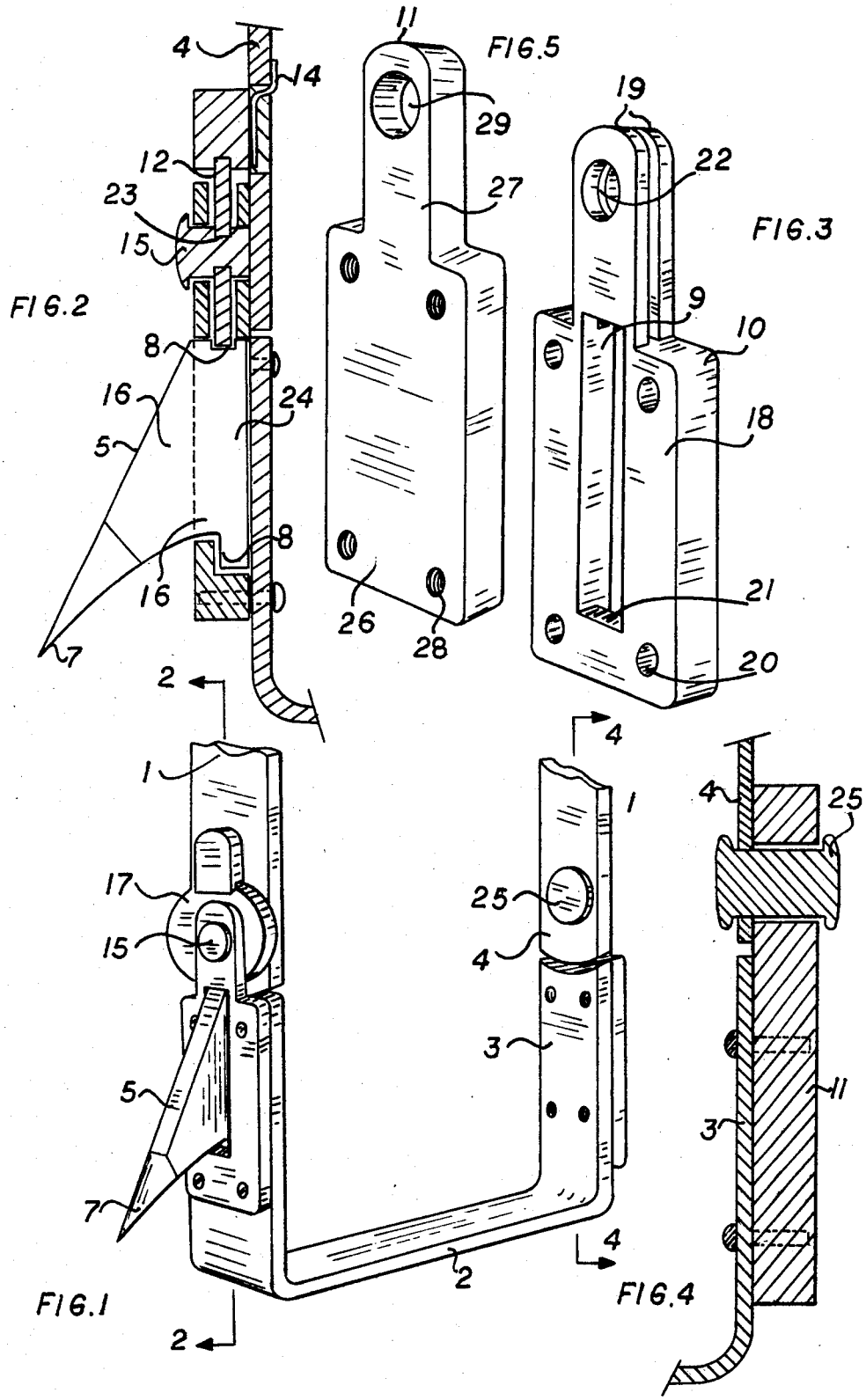
FIG. 1 is a perspective view of the climber.
FIG. 2 is a cross-sectional side view of the inner side of the climber with the gaff.
FIG. 3 is a perspective view of the swinging bracket used along with the gaff in FIG. 2.
FIG. 4 is a cross-sectional side view of the outer side of the climber.
FIG. 5 is a perspective view of the swinging bracket used in FIG. 4.

The climber illustrated in the drawings comprises a pair of braces or upright members 1, a U-shaped stirrup 2, two swinging brackets 10 and 11, one disc 12, a push button 13, a leaf spring 14, a gaff 5 and two hinge axles 15 and 25.

As illustrated in FIG. 1 the braces or upright members 1 embrace the inner and outer sides of the leg and extend upwardly above the ankle of the wearer. The stirrup 2 extends below the ankle of the wearer and is adapted to fit the instep of the boot.

The hinge axle 15 and 25 join the upper ends 3 of the stirrup to the lower ends 4 of the upright members 1.

The gaff 5 is generally of the shape shown in FIGS. 1 and 2. It comprises a main body 16 which extends downwardly into a pointed tip 7, and a connecting base 6. The connecting base 6 has a nib 8 at each opposite end.

Referring now to FIGS. 1 and 2 the disc 12 is generally of a circular shape, and comprises a gap 17. When installed, the disc 12 inserts in a recessed track 23 of the hinged axle 15 and rotates around it.

A leaf spring 14 is mounted against the lower end 4 of the inner side of the upright member 1 and acts against the back of the push button 13.

As shown in FIG. 3, the swinging bracket 10 comprises a main rectangular body 18 which extends upwardly into a pair of smaller heads 19 of a generally rectangular shape.

The body 18 comprises a rectangular shape cavity 9, four bores 20, and a ledge 21. Each head 19 comprises one hole 22.

The cavity 9 is shaped and dimensioned as to receive the connecting base 6. The ledge 21 is located at the lower side of the body 18. This ledge 21 acts on the lower nib 8 of the connecting base 6 and prevents its extraction.

The four bores 20 receive four screws to tighten the swinging bracket 10 to the upper end 3 of the stirrup 2.

As shown in FIG. 3, the heads 19 are parallel to one another, and are spaced in such a way to accomodate a disc 12. The two hole 22 are of a circular shape and are dimensioned to fit the hinge axle 15.

To install the gaff 5 the user engages the lower nib 8 behind the ledge 21. The back side 24 of the gaff 5 then rests against the outer side of the stirrup 2. With the push button 13 pressed, the user rotates the disc 12 around the hinge axle 15 until the disc gap 17 matches the push button 13. When the push button 13 is released, it engages the disc gap 17, thus preventing the disc 12 from rotating around the hinge axle 15. The portion of the disc diametrically opposite to the disc gap 17 acts against the upper nib 8 of the connecting base 6. Both nibs 8 being stabilized in their locations by disc 12 and ledge 21, the gaff is therefore securely locked against the upper end 3 of the stirrup 2.

When the climber is in use, a force is exerted on the pointed tip 7 of the gaff 5 in an upward direction as to secure its locked position.

Important features of the present invention include the structure and arrangement of the upright members 1, the U-shaped stirrup 2 and the gaff mounting and release assembly. The gaff 5 is readily replaceable and neither the upright members 1 nor the stirrup 2 need to be discarded.

To replace the gaff 5, the user pushes the release button 13, which in turn acts against and forces leaf spring 14 backward. When the push button 13 is in such a backward position, it disengages from the disc gap 17. The user then rotates disc 12 around the track 23 of the hinge axle 15, until the disc gap 17 faces the upper nib 8. Gaff 5 could thereafter be disengaged by tilting it sideways and then lifting it upwardly.

As illustrated in FIG. 4, the outer side of the climber comprises a swinging bracket 11 and a hinge axle 25. The swinging bracket 11 in FIG. 5 comprises a main rectangular body 26 which extends upwardly into one smaller head 27 of a generally rectangular shape.

The body 26 comprises four bores 28 which receive four screws to tighten the swinging bracket 11 to the upper end 3 of the stirrup 2.

The head 27 comprises one circular hole 29 which accomodates the hinge axle 25.

When both assemblies shown in FIGS. 2 and 4 are installed, the climber could be easily articulated about the ankle to allow dorsal flexion when walking.

While the invention has been described in connection with a preferred embodiment, it is understood that the alternatives, modifications and improvements may be apparent to those skilled in the art in view of the foregoing description. Those modifications, alternatives and improvements therefore fall within the spirit and scope of the following claims.

What is claimed is:

1. A climbing device securable to the foot and leg of the user which comprises:

a pair of upright members respectively securable to either side of the user's lower leg;

a generally U-shaped stirrup;

means for rotatively securing the upper ends of the stirrup to the lower ends of said upright members at ankle level;

a gaff having a connecting base and a pointed tip extending from said base; and means for releasably attaching the base of the gaff to one side of said stirrup.

2. The device of claim 1 wherein said means for attaching comprises:

said base having a nib at each opposite end;

said one side having a cavity shaped and dimensioned to receive said connecting base; and means withing said cavity for acting against said nibs to prevent the extraction of the base.

3. The device of claim 2 wherein said means for rotatively securing comprises:

two swinging brackets mounted on the outer side of the upright members;

means for rotatively locking the upper part of said brackets to the lower end of the upright members; and means for tightening the lower part of said bracket to the upper end of the stirrup.

4. The device of claim 3, wherein the upper part of said brackets comprises a hole; and said means for locking comprises a hinge axle of a generally rectangular shape, which is shaped and dimensioned to fit in the hole, and which inserts in the lower end of the upright member.

5. The device of claim 4, wherein said means for acting comprises:

the inner ledge of the hinge axle, which acts against the lower nib of said connecting base; and means for acting against the upper nib of said connecting base.

6. The device of claim 5, wherein the means for acting comprises:

a circular disc which engages around the hinge axle; and means for disconnecting the gaff.

7. The device of claim 6 wherein the means for disconnecting comprises:

a leaf spring mounted against the inner side of said upright member;

a push button acting against said spring and accessible from the outer face of said member.

* * * * *